US011160398B2

(12) United States Patent
Chan

(10) Patent No.: US 11,160,398 B2
(45) Date of Patent: Nov. 2, 2021

(54) PILLOW SYSTEMS

(71) Applicant: King Chan, Lake Oswego, OR (US)

(72) Inventor: King Chan, Lake Oswego, OR (US)

( * ) Notice: Subject to any disclaimer, the term of this patent is extended or adjusted under 35 U.S.C. 154(b) by 149 days.

(21) Appl. No.: 16/511,574

(22) Filed: Jul. 15, 2019

(65) Prior Publication Data

US 2021/0015278 A1 Jan. 21, 2021

(51) Int. Cl.
*A47G 9/10* (2006.01)

(52) U.S. Cl.
CPC ..... *A47G 9/1072* (2013.01); *A47G 9/1081* (2013.01); *A47G 2009/1018* (2013.01)

(58) Field of Classification Search
CPC ..... A47G 9/1072; A47G 9/1081; A47G 2009/1018; A47G 9/10; A47G 9/1036; A47C 27/142
USPC ..... 5/633–645; D6/601
See application file for complete search history.

(56) References Cited

U.S. PATENT DOCUMENTS 2,305,173 A * 12/1942 Leeb ..... A47G 9/007 5/641
3,239,854 A * 3/1966 Freedlander ..... A47C 27/144 5/636
3,753,264 A * 8/1973 Grenier ..... A47G 9/10 5/645
3,851,347 A * 12/1974 Ashley ..... A47C 27/146 5/636
4,325,151 A * 4/1982 Wu ..... A47G 9/1036 165/185
4,832,007 A * 5/1989 Davis, Jr. ..... A47G 9/1081 250/580
D371,462 S * 7/1996 Grossmith ..... D6/349
D406,718 S * 3/1999 Jacobs, I ..... D6/601
6,292,964 B1 * 9/2001 Rose ..... A47G 9/10 5/630
7,007,328 B1 * 3/2006 Bailey ..... A47C 9/027 5/632
7,111,347 B1 * 9/2006 Cottrell ..... A47D 13/083 5/490
D805,325 S * 12/2017 Chan ..... D6/601
D878,807 S * 3/2020 Marinkovic ..... D6/601
2006/0070185 A1 * 4/2006 Rubio ..... A47C 20/04 5/732
2015/0026897 A1 * 1/2015 Chunglo ..... A47C 27/144 5/724

* cited by examiner

*Primary Examiner* — Myles A Throop

(57) ABSTRACT

Pillow systems including a base pillow extending from an upper back end to a head end opposite the upper back end along a sagittal midline of a user, a neck support pillow operatively supported on the base pillow between the upper back end and the head end in a position configured to underlie a neck of the user, wherein the base pillow is configured to support a back and a head of the user by underlying at least a portion of the back and at least a portion of the head, and the neck support pillow is configured to support the neck of the user by underlying the neck of the user. In some examples, the pillow system includes a spacer pillow supported on the base pillow between the upper back end and the head end.

20 Claims, 6 Drawing Sheets

PILLOW SYSTEMS

BACKGROUND

The present disclosure relates generally to pillow systems. In particular, pillow systems configured to elevate and support a user's head, neck, and back are described.

Pillows are important for comfort, support, and effective sleep. Pillows come in a variety of sizes, shapes, materials, and compressibilities. Pillows find application in wide range of settings, such as one's bedroom, hospitals, and airplanes.

Known pillows are not entirely satisfactory for the range of applications in which they are employed. For example, existing pillows fail to provide sufficient support to a user's head, neck, and back. Moreover, conventional pillows seeking to provide more support suffer from being hard and uncomfortable.

Further, existing pillows lack effective means to adjust the angle at which the user's head, neck, and back are supported, which limits their ability to adequately support the user's anatomy. Lack of support angle adjustability also limits the comfort of conventional pillows. In addition, conventional pillows lack sufficient height adjustability.

Thus, there exists a need for pillows that improve upon and advance the design of known pillows. Examples of new and useful pillow systems relevant to the needs existing in the field are discussed below.

Disclosure addressing one or more of the identified existing needs is provided in the detailed description below. An example of a reference relevant to pillow systems includes U.S. patent D805325. The complete disclosure of the above patent is herein incorporated by reference for all purposes.

SUMMARY

The present disclosure is directed to pillow systems including a base pillow extending from an upper back end to a head end opposite the upper back end along a sagittal midline of a user, a neck support pillow operatively supported on the base pillow between the upper back end and the head end in a position configured to underlie a neck of the user, wherein the base pillow is configured to support a back and a head of the user by underlying at least a portion of the back and at least a portion of the head, and the neck support pillow is configured to support the neck of the user by underlying the neck of the user. In some examples, the pillow system includes a spacer pillow supported on the base pillow between the upper back end and the head end.

DETAILED DESCRIPTION

The disclosed pillow systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various pillow systems are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

User Anatomy

The anatomy of user 108 shown in FIG. 1 will be briefly described to aid the discussion of pillow system 100 below. The particular anatomy shown in FIG. 1 will of course vary from person to person. In some examples, the pillow systems discussed herein are configured for use with pets and other animals, which will have different anatomy.

Figure 1:
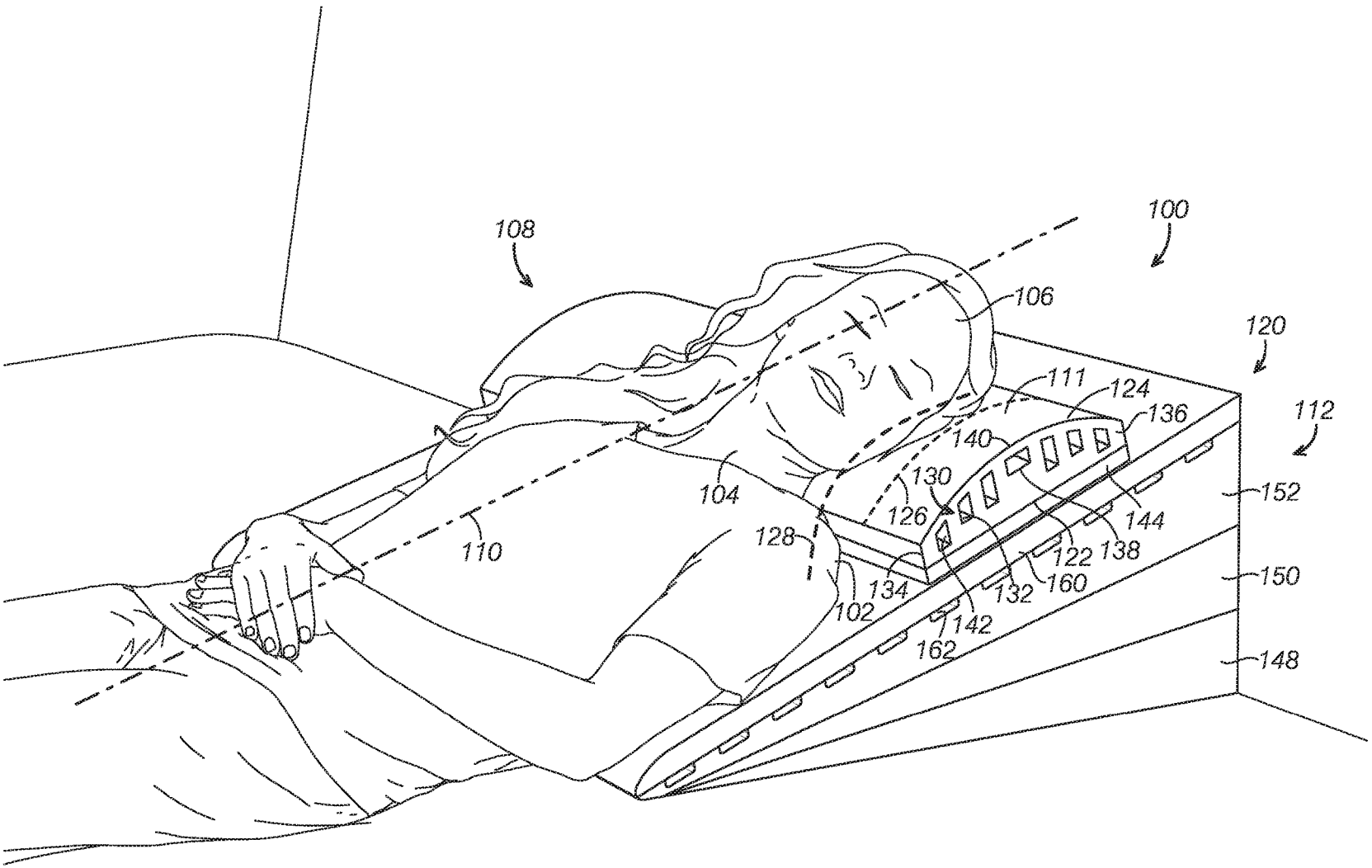
FIG. 1 is a perspective view of a user resting on a first example of a pillow system, the figure depicting a sagittal midline of the user and the pillow system supporting a user's back, neck, and head.

As can be seen in FIG. 1, user 108 includes a back 102, a neck 104, and a head 106. Back 102, neck 104, and head 106 of user 108 are aligned about an imaginary sagittal midline 110 of user 108. User 108 further includes an anatomical arch 128 defined by the contour of an upper portion of back 102, neck 104, and head 106 of user 108.

The reader will appreciate that back 102 includes at least portions of the shoulders and shoulder blades of user 104. All or a substantial majority of the user's back may be supported by the pillow systems depending on the height of the user and/or the size of the pillow system.

When user 108 is lying down or in a reclined position, user 108 benefits from her back 102, neck 104, and head 106 being supported by pillow system 100. Though not pictured in the figures, the pillow systems described herein are suitable for use by a user lying on the pillow system while facing the pillow system or on her side. In such examples, the user's chest or side torso contacts the pillow system instead of the user's upper back.

Pillow Systems

The pillow systems described herein function to comfortably support a user's head, neck, and back. The presently described pillow systems are height adjustable as well as support angle adjustable. The reader will appreciate from the figures and description below that the currently described pillow systems address shortcomings of conventional pillows.

For example, the pillow systems described herein provide robust support to a user's head, neck, and back. The present pillow systems provide multiple means to adjust the angle at which the user's head, neck, and back are supported. The multiple adjustment means increases the pillow system's ability to adequately support the user's head, neck, and back and increases the user's comfort.

In addition, the pillow systems disclosed herein provide multiple means to adjust their height, which improves their ability to support the user and makes them more comfortable to use. Unlike conventional pillows that sacrifice comfort to increase support, the presently described pillow systems provide highly effective support without diminishing comfort for the user.

With reference to FIGS. 1-6, a first example of a pillow system, pillow system 100, will now be described. Pillow system 100 includes a base pillow 112, a neck support pillow 111, and a spacer pillow 144.

In other examples, the pillow system includes additional or alternative features, such as covers to cover one or more of the base pillow, the neck support pillow, and the spacer pillow. In some examples, the pillow system includes multiple spacer pillows or no spacer pillows. In certain examples, the pillow system does not include a neck support pillow or a base pillow.

Base Pillow

Figure 2:
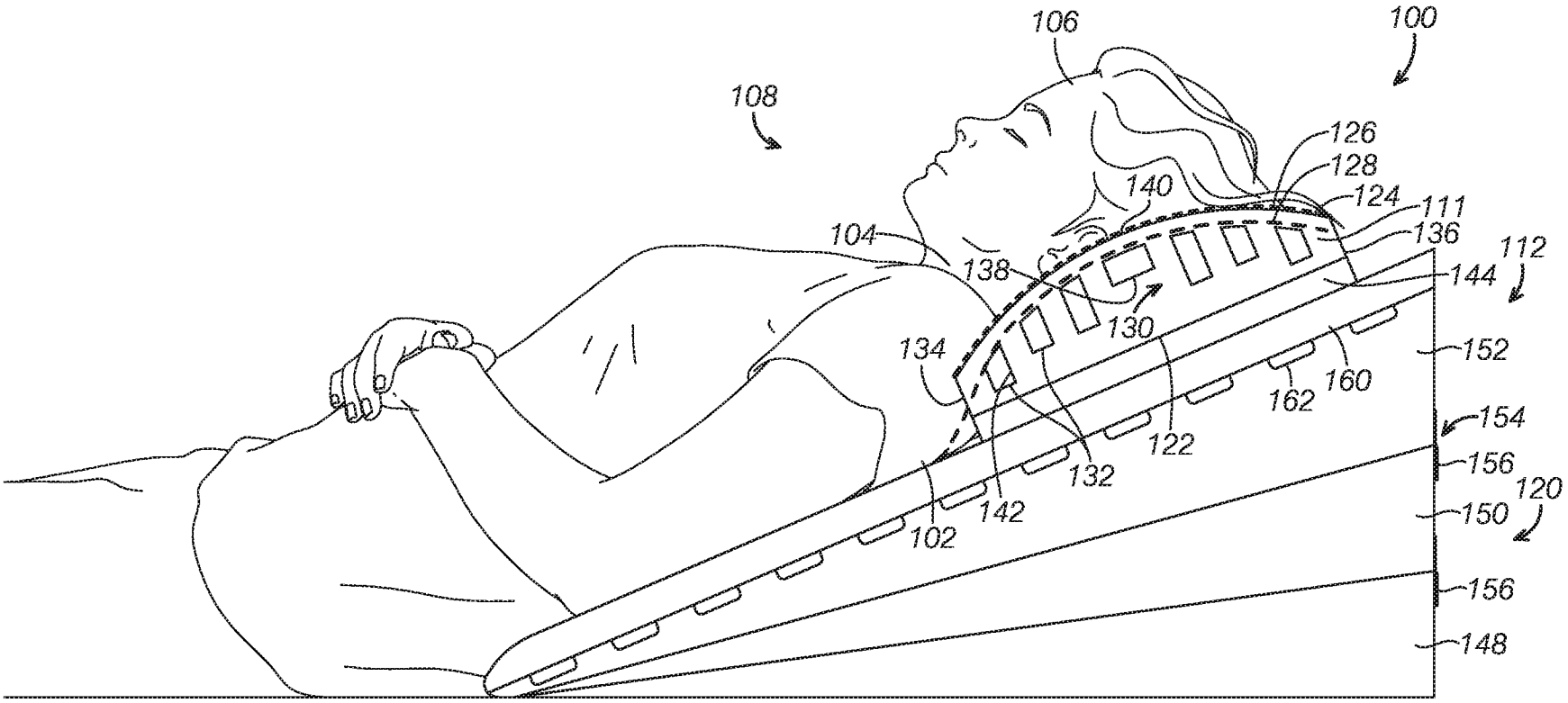
FIG. 2 is a side view of the pillow system shown in FIG. 1 supporting the user, the figure depicting an anatomical arch of the user defined by the contour of the upper back, the neck, and the head of the user.
Figure 3:
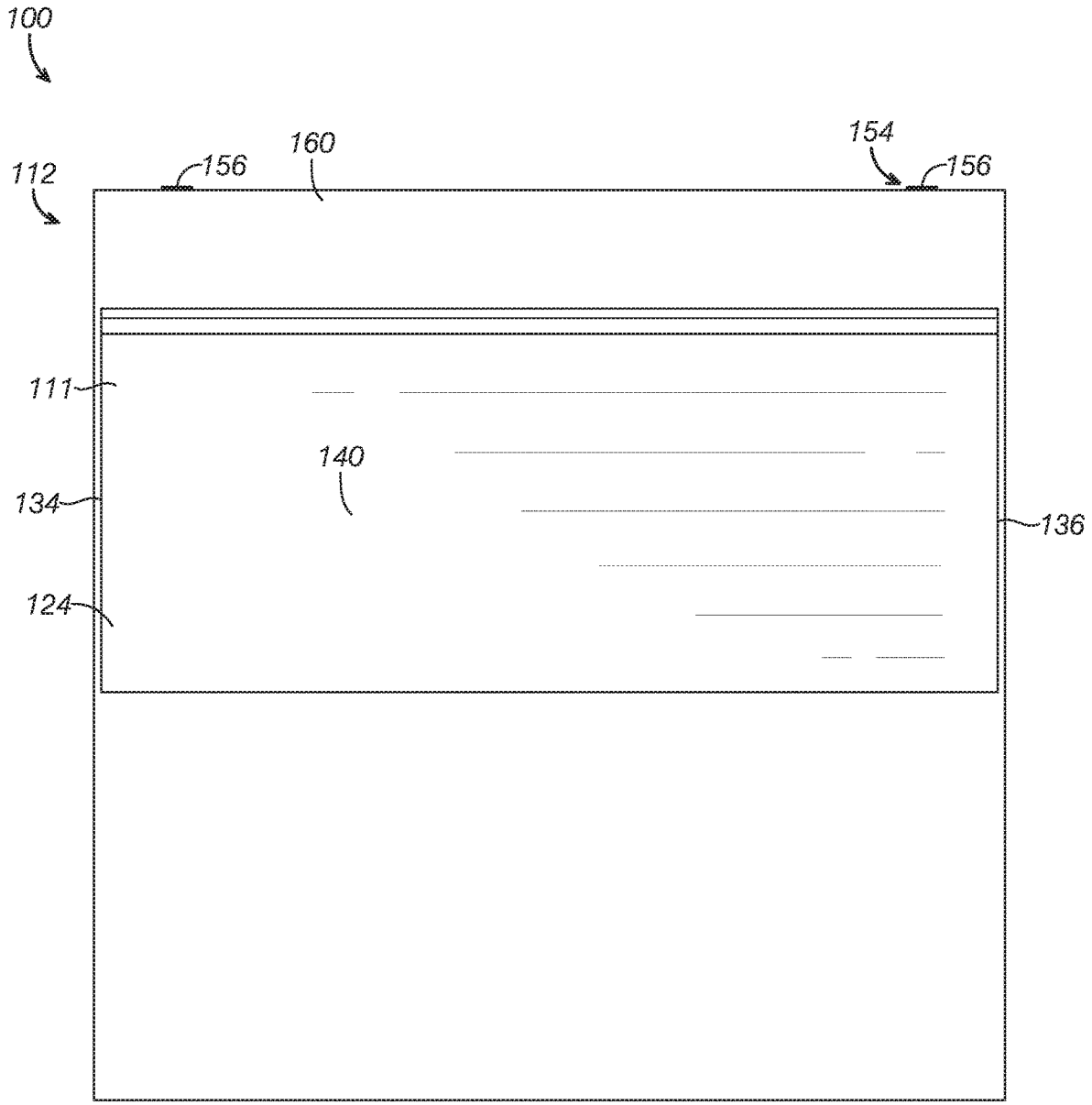
FIG. 3 is a top view of the pillow system shown in FIG. 1 depicting the neck support pillow and the spacer pillow having substantially the same dimensions in in the direction of the sagittal midline and in a latitudinal direction transverse to the sagittal midline such that the neck support pillow mostly obscures the spacer pillow from above.
Figure 4:
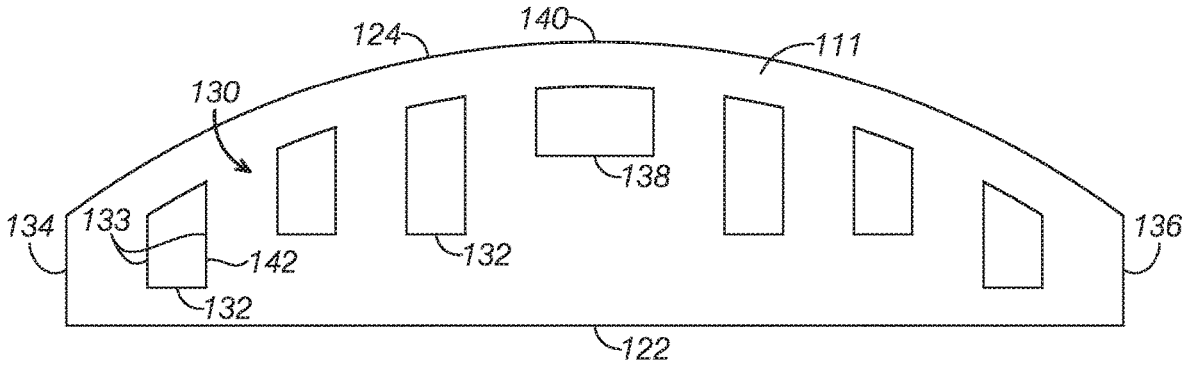
FIG. 4 is a side view of the neck support pillow shown in FIG. 1.

Base pillow 112 functions to support user 108 and the other components of pillow system 100 from the ground or other support surface, such as a mattress, couch cushion, or table, for instance, a medical procedure table. The reader can see in FIGS. 1-3 and 5 that base pillow 112 extends from an upper back end 113 to a head end 115 opposite upper back end 113 along sagittal midline 110 of user 108. As shown in FIGS. 1 and 2, base pillow 112 is configured to support back 102 and head 106 of user 108 by underlying at least a portion of back 102 and at least a portion of head 106.

With reference to FIGS. 1 and 2, the reader can see that base pillow 112 is inclined to define a wedge 120. The wedge shape of base pillow 112 helps to support user 108 at a comfortable angle with head 106 elevated relative to other parts of the body of user 108.

In the present example, base pillow 112 is formed from a memory foam material. In other examples, the base pillow is comprised of other types of foam, latex, polyester, gels, feathers, or other suitable materials. The base pillow may be formed from any currently known or later developed material suitable for pillows.

As shown in FIGS. 1, 2, 5, and 6, base pillow 112 includes a first wedge pillow 148, a second wedge pillow 150, a third wedge pillow 152, and a top pillow layer 160. Second wedge pillow 150 is removably supported on first wedge pillow 148 and third wedge pillow 152 is removably supported on second wedge pillow 150.

As shown in the figures, third wedge pillow 152 defines a plurality of base pillow channels 162 extending transverse to sagittal midline 110. Base pillow channels 162 function to provide ventilation and thermal regulation. Base pillow channels further provide softer cushioning by defining areas where third wedge pillow 152 is designed to collapse or compress to a greater degree than surrounding portions.

Top pillow layer 160 is secured to third wedge pillow 152 proximate user 108 and provides an extra layer of cushioning to support user 108 resting on base pillow 112. Top pillow layer 160 also functions to cover base pillow channels 162 formed in third wedge pillow 152.

Figure 5:
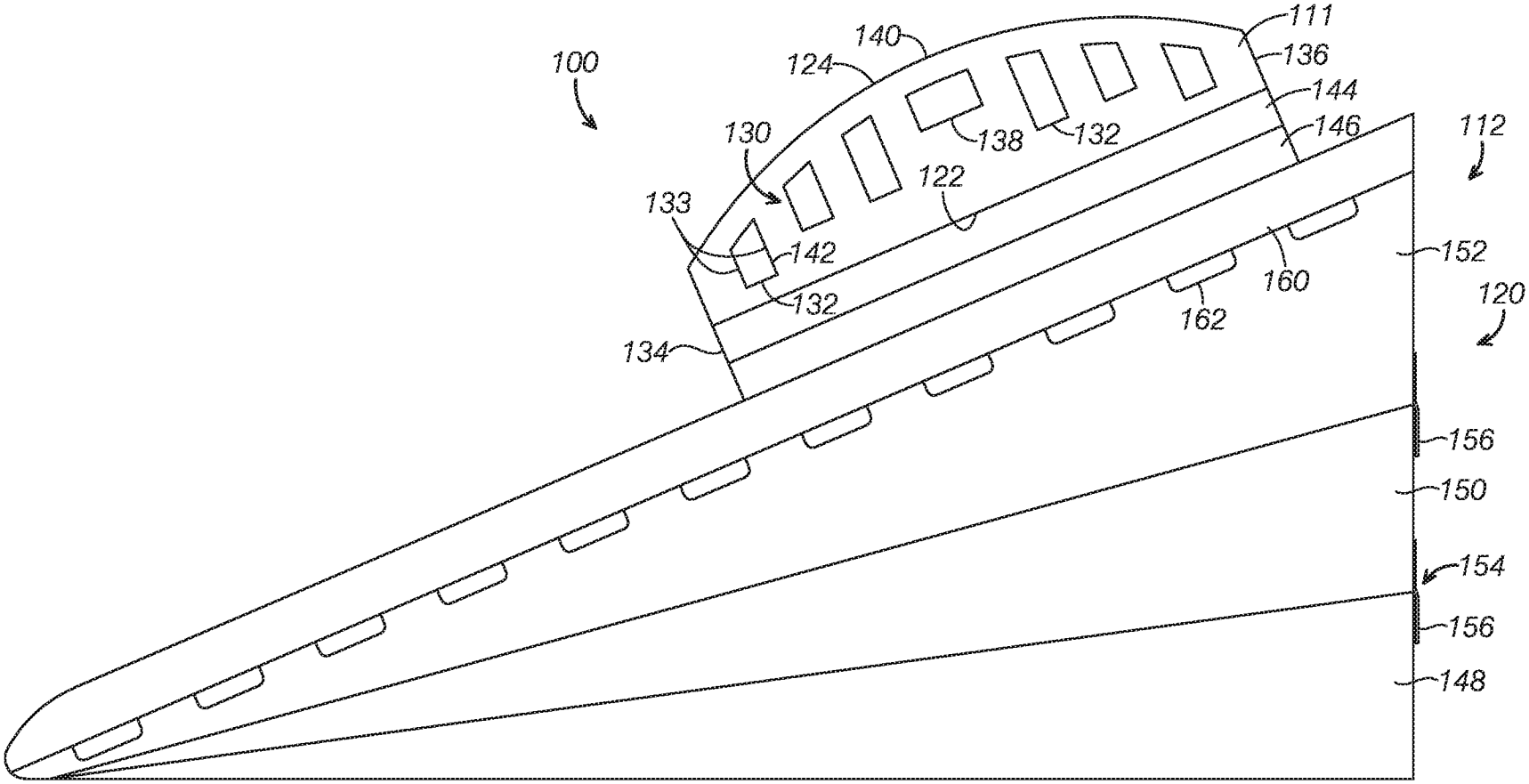
FIG. 5 is a side view of the pillow system shown in FIG. 1 including two spacer pillows to adjust the height and support angle of the pillow system relative to the configuration shown in FIG. 1.
Figure 6:
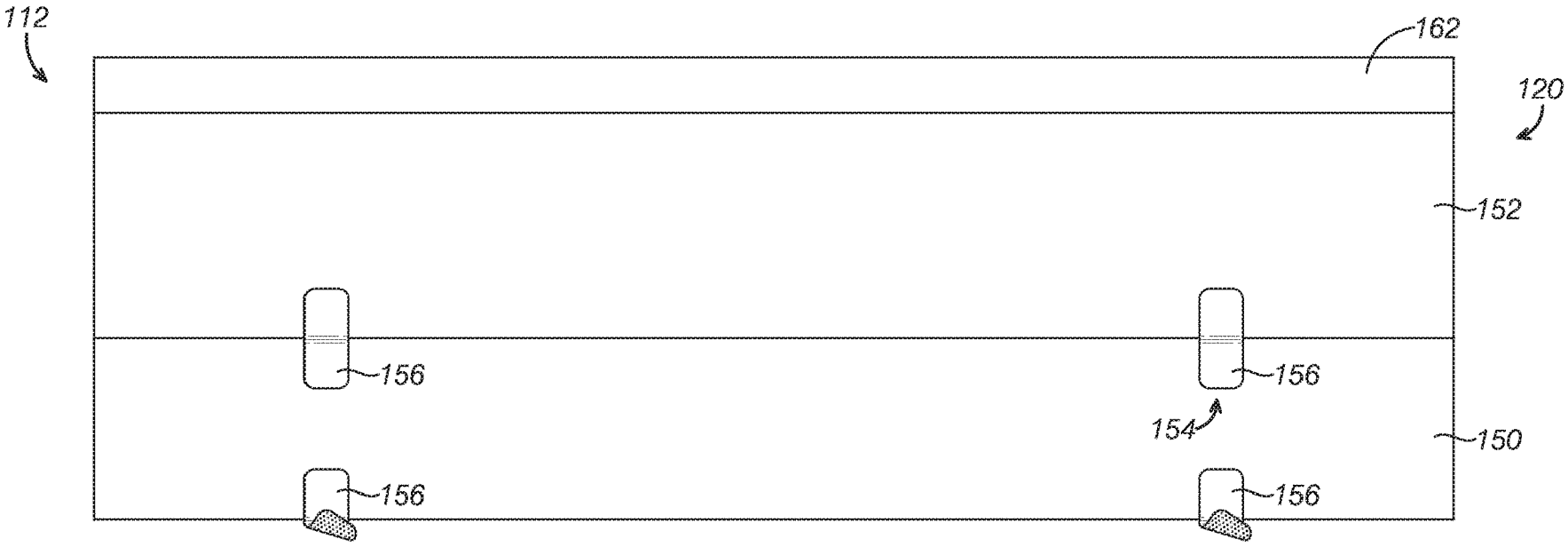
FIG. 6 is a rear view of the pillow system shown in FIG. 1 depicting the base pillow with a first wedge pillow selectively removed to adjust the height and support angle of the base pillow and the pillow system relative to the configuration shown in FIG. 1.

In the example shown in FIG. 6, first wedge pillow 148 is selectively removed to adjust the height and support angle of base pillow 112 and pillow system 100 relative to the configuration shown in FIGS. 1, 2, and 5. By selectively adding and removing wedge pillows 148, 150, and/or 152 from base pillow 112, user 108 may adjust the height and support angle of base pillow 112 and pillow system 100.

The reader can appreciate that base pillow 112 including multiple, independent pillow components results in a customizable, flexible system. The multi-component pillow system provides the user with a wide variety of adjustment options and provides multiple use applications.

For example, a user may use one of the wedge pillows, for example, second wedge pillow 150, with spacer pillow 144 and neck support pillow 111 while using first wedge pillow 148 and third wedge pillow 152 for other applications. For instance, first wedge pillow 148 and third wedge pillow 152 could be placed side by side on a bed or other surface and used by two people laying next to each other. Alternatively, first wedge pillow 148 and third wedge pillow 152 could be stacked on top of each other and used by a single user to support her head, neck, and shoulders in a higher position than had she laid on just one of the first wedge pillow 148 or third wedge pillow 152 individually.

In another use application, a user may place first wedge pillow 148 in one room and a third wedge pillow 152 in another room to have wedge pillows available for use in multiple rooms. The pillow system itself utilizing second wedge pillow 150, spacer pillow 144, and neck support pillow 111 could be located in a third room or location.

Thus, the reader can see that the pillow system including multiple, independent components allows the user to combine the components as desired to established a desired support angle and height for the pillow support system while also allowing the user to use the components independently as pillows in multiple locations and/or for multiple users.

As shown in FIGS. 2, 3, 5, and 6, base pillow 112 includes a fastener system 154 for selectively securing wedge pillows 148, 150, and/or 152 together. Fastener system 154 includes fasteners 156 configured to releasably couple adjacent wedge pillows together. Fastener system 154 is configured to selectively couple each wedge pillow together interchangeably. Expressed another way, fasteners 156 function to: A) selectively couple first wedge pillow 148 to second wedge pillow 150, to third wedge pillow 152, or to both; B) to selectively couple second wedge pillow 150 to first wedge pillow 148, to third wedge pillow 152, or to both; or C) to selectively couple third wedge pillow 152 to second wedge pillow 150, to first wedge pillow 148, or to both.

In the present example, fasteners 156 are hook and loop fasteners with a hook portion disposed on one wedge pillow and a corresponding loop portion disposed on an adjacent wedge pillow. In other examples, different types of fasteners are used, such as detent mechanisms, mechanical fasteners, magnetic fasteners, or adhesive fasteners. The fasteners may be any currently known or later developed type of fastener suitable for use in pillow applications.

In some examples, the base pillow does not include fasteners. In certain examples, the interface between the wedge pillows includes a slip-resistant layer that serves to resist adjacent wedge pillows sliding relative to each other.

Spacer Pillow

As shown in FIGS. 1-6, spacer pillows 144 and 146 function to elevate neck support pillow 111 to a desired height selected to provide a desired amount of support to neck 104 of user 108. The height adjustability of the spacer pillows may be achieved multiple ways beyond that shown in FIGS. 1-6. In some examples, the pillow system provides a single spacer pillow with a height selected to support the neck support pillow at the desired height. In other examples, the pillow system includes two or more spacer pillows of different heights and the user selects the spacer pillow with a height best suited to support the neck support pillow at the desired height.

In the example shown in FIGS. 1-6, pillow system 100 includes two spacer pillows 144 and 146, which are substantially identical. In pillow system 100, the user positions neck support pillow 111 at a desired height by selectively combining or excluding spacer pillows 144 and 146. For example, user 108 may stack both spacer pillows 144 and 146 on base pillow 112 and place neck support pillow 111 on the stack of spacer pillows 144 and 146 as shown in FIG. 5. Alternatively, user 108 may place a single spacer pillow 144 on base pillow 112 and then place neck support pillow 111 on spacer pillow 144 as shown in FIGS. 1 and 2. Another option not pictured in the figures is to place neck support pillow 111 directly on base pillow 112 (whichever combination of first, second, and third wedge pillows 148, 150, and 152 the user desires for the configuration of base pillow 112).

As shown in FIGS. 1-3 and 5, spacer pillow 144 is complementarily configured with neck support pillow 111. In the present example, spacer pillow 144 has substantially the same dimension as neck support pillow 111 in the direction of sagittal midline 110. As mentioned before and as shown in FIG. 5, spacer pillows 144 and 146 are substantially identical, which makes spacer pillow 146 complementarily configured with neck support pillow 111 as described for spacer pillow 144. The reader can see in FIGS. 1-3 and 5 that spacer pillows 144 and 146 have substantially the same dimension as neck support pillow 111 in a latitudinal direction transverse to sagittal midline 110.

In other examples, the spacer pillows are not complementarily configured with the neck support pillow. In some instances, the spacer pillows are complementarily configured with the base pillow instead of the neck support pillow or are independent sizes not closely complementing the profile of the neck support pillow or the base pillow.

In the present example, spacer pillows 144 and 146 are comprised of a memory foam material. In other examples, the spacer pillows are comprised of other types of foam, latex, polyester, gels, feathers, or other suitable materials. The spacer pillows may be formed from any currently known or later developed material suitable for pillows.

Neck Support Pillow

As shown in FIGS. 1-5, neck support pillow 111 is configured to support neck 104 of user 108 by underlying neck 104 of user 108. Neck support pillow 111 is operatively supported on base pillow 112 via spacer pillow 144 or spacer pillows 144 and 146. The reader can see in FIG. 1 that neck support pillow 111 is disposed between upper back end 113 and head end 115 of base pillow 112 in a position configured to underlie neck 104 of user 108.

With reference to FIGS. 1-5, the reader can see that neck support pillow 111 includes a bottom face 122 proximate base pillow 112. Neck support pillow 111 further includes a top face 124 opposite base pillow 112. With further reference to FIGS. 1-5, the reader can see that neck support pillow 111 includes a first sagittal end 134 proximate upper back end 113 of base pillow 112 and a second sagittal end 136 proximate head end 115 of base pillow 112.

Top face 124 extends in an arch 126 along sagittal midline 110 of user 108. As shown in FIG. 1, arch 126 complements anatomical arch 128 of user 108. Arch 126 complementing arch 128 of user 108 significantly improves the comfort and support of neck support pillow 111.

As shown in FIGS. 1, 2, 4, and 5, neck support pillow 111 defines a series of channels 130 between top face 124 and bottom face 122. As can be seen in FIG. 1, series of channels 130 extend in a lateral direction transverse to sagittal midline 110 of user 108. Each channel 142 in series of channels 130 is defined by two sidewalls and a floor 132.

In the present example, the sidewall height of each channel is selected to provide neck support pillow 111 with a selected amount of cushion. Further, the floor height of each channel is selected to provide a selected amount of support. The floor height is defined by the distance between bottom face 122 of neck support pillow 111 and floor 132 of channel 142. The sidewall height is defined by the distance between floor 132 of a channel 142 in series of channels 130 and top face 124 of neck support pillow 111.

As shown in FIGS. 1-5, neck support pillow 111 defines an apex channel 138 in series of channels 130 proximate an apex 140 of arch 126 of top face 124. The floor height of apex channel 138 is larger than floor height of channel 142 proximate first sagittal end 134 to increase the floor height of apex channel 138 and to provide more support to user 108 at apex channel 138. The reader can see in FIG. 4 that the floor height of channel 142 proximate second sagittal end 136 is smaller than floor height of apex channel 138. In the present example, the floor height of channel 142 proximate first sagittal end 134 and the floor height of channel 142 proximate second sagittal end 136 are substantially the same. However, in other examples, the floor heights are different on opposite sagittal ends.

With reference to FIGS. 1-5, the reader can see that, in the present example, the sidewall height of apex channel 138 is smaller than the sidewall height of channel 142 proximate first sagittal end 134. The sidewall height of apex channel 138 is also smaller than the sidewall height of channel 142 proximate second sagittal end 136 in the present example. The sidewall height of apex channel 138 being smaller than the sidewall height of the channels proximate the opposite sagittal ends serves to reduce the cushioning and increase the support of the apex channel relative to the channels proximate the sagittal ends. In other examples, the sidewall height of the apex channel is the same or larger than the sidewall height of one or both of the channels proximate the sagitta ends.

In the present example, neck support pillow 111 is formed from a memory foam material. In other examples, the neck support pillow is comprised of other types of foam, latex, polyester, gels, feathers, or other suitable materials. The neck support pillow may be formed from any currently known or later developed material suitable for pillows.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A pillow system to support a back, a neck, and a head of a user, the back, the neck, and the head of the user being aligned about a sagittal midline of the user, the pillow system comprising:

a base pillow extending from an upper back end to a head end opposite the upper back end along the sagittal midline of the user; and a neck support pillow operatively supported on the base pillow between the upper back end and the head end in a position configured to underlie the neck of the user;

wherein:

the base pillow is configured to support the back and the head of the user by underlying at least a portion of the back and at least a portion of the head;

the neck support pillow is configured to support the neck of the user by underlying the neck of the user;

the neck support pillow defines an apex channel in a series of channels proximate an apex of the arch of a top face of the neck support pillow, at least one first one of the series of channels is disposed between a first sagittal end of the neck support pillow and apex channel;

at least one second one of the series of channels is disposed between a second sagittal end of the neck support pillow and the apex channel;

a sidewall height is defined by the distance between a floor of each channel in the series of channels and the top face of the neck support pillow; and the sidewall height of the apex channel is smaller than the sidewall height of at least one of the channels proximate the first sagittal end and the second sagittal end of the neck support pillow.

2. The pillow system of claim 1, wherein the base pillow is inclined to define a wedge.

3. The pillow system of claim 1, wherein the neck support pillow includes:

a bottom face proximate the base pillow; and a top face opposite the base pillow, the top face extending in a support arch along the sagittal midline of the user, the support arch complementing an anatomical arch of the user defined by a contour of the back, the neck, and the head of the user.

4. The pillow system of claim 3, wherein the neck support pillow defines a series of channels between the top face and the bottom face, the series of channels extending in a lateral direction transverse to the sagittal midline of the user.

5. The pillow system of claim 4, wherein each channel in the series of channels is defined by two sidewalk and a floor.

6. The pillow system of claim 1, wherein:

a floor height is defined by the distance between a bottom face and a floor of a channel between a top face of the neck support pillow and a bottom face of the neck support pillow, the channel extending in a lateral direction transverse to the sagittal midline of the user;

the neck support pillow includes a first sagittal end proximate the upper back end of the base pillow;

the neck support pillow includes a second sagittal end proximate the head end of the base pillow;

the neck support pillow defines an apex channel in a series of channels proximate an apex of the arch of the top face; and the floor height of the apex channel is larger than the floor height of the channel proximate the first sagittal end.

7. The pillow system of claim 6, wherein the floor height of the channel proximate the second sagittal end is smaller than the floor height of the apex channel.

8. The pillow system of claim 7, wherein the floor height of the channel proximate the first sagittal end and the floor height of the channel proximate the second sagittal end are substantially the same.

9. The pillow system of claim 1, further comprising a spacer pillow disposed between the base pillow and the neck support pillow.

10. The pillow system of claim 9, wherein the height of the spacer pillow is selected to elevate the neck support pillow to a desired height selected to provide a desired amount of support to the neck of the user.

11. The pillow system of claim 9, wherein:

the spacer pillow defines a first spacer pillow; and the pillow system further comprises a second spacer pillow disposed between the first spacer pillow and the base pillow.

12. The pillow system of claim 11, wherein the combined height of the first spacer pillow and the second spacer pillow is selected to elevate the neck support pillow to a desired height selected to provide a desired amount of support to the neck of the user.

13. The pillow system of claim 9, wherein the spacer pillow is complementarily configured with the neck support pillow to have substantially the same dimension as the neck support pillow in the direction of the sagittal midline.

14. The pillow system of claim 1, wherein the base pillow includes:

a first wedge pillow;

a second wedge pillow removably supported on the first wedge pillow; and a third wedge pillow removably supported on the second wedge pillow.

15. The pillow system of claim 14, wherein the base pillow further includes a fastener system configured to selectively secure the third wedge pillow to either the second wedge pillow or the first wedge pillow.

16. A pillow system to support a back, a neck, and a head of a user, the back, the neck, and the head of the user being aligned about a sagittal midline of the user, the pillow system comprising:

a base pillow extending from an upper back end to a head end opposite the upper back end along the sagittal midline of the user, and a neck support pillow operatively supported on the base pillow between the upper back end and the head end in a position configured to underlie the neck of the user; wherein:

the base pillow is configured to support the back and the head of the user by underlying at least a portion of the back and at least a portion of the head;

the neck support pillow is configured to support the neck of the user by underlying the neck of the user;

the neck support pillow defines a series of channels between a top face of the neck support pillow and a bottom face of the neck support pillow, the series of channels extending in a lateral direction transverse to the sagittal midline of the user;

a floor height is defined by the distance between a bottom face and a floor of the channel;

the neck support pillow includes a first sagittal end proximate the upper back end of the base pillow;

the neck support pillow include a second sagittal end proximate the head end of the base pillow;

the neck support pillow defines an apex channel in a series of channels proximate an apex of the arch of the top face;

the floor height of the apex channel is larger than the floor height of the channel proximate the first sagittal end;

a sidewall height is defined by the distance between the floor of each channel in the series of channels and the top face; and the sidewall height of the apex channel is smaller than the sidewall height of the channel proximate the first sagittal end.

17. The pillow system of claim 16, wherein the sidewall height of the apex channel is smaller than the sidewall height of the channel proximate the second sagittal end.

18. The pillow system of claim 16, wherein the sidewall height of each channel is selected to provide a selected amount of cushion.

19. The pillow system of claim 18, therein the floor height of each channel is selected to provide a selected amount of support.

20. A pillow system to support a back, a neck; and a head of a user, the back, the neck, and the head of the user being aligned about a sagittal midline of the user, the pillow system comprising:

a neck support pillow comprised of foam in a position configured to underlie the neck of the user, the neck support pillow comprising:

a bottom face proximate to and above a support surface that is supporting the user; and a top face opposite the bottom face, the top face extends in a support arch along the sagittal midline of the user, the support arch complementing an anatomical arch of the user defined by a contour of the back, the neck, and the head of the user;

wherein:

the neck support pillow is configured to support the neck of the user by underlying the neck of the user;

the neck support pillow defines a series of channels between the top face and the bottom face, the series of channels extending in a lateral direction transverse to the sagittal midline of the user;

the neck support pillow defines an apex channel in the series of channels proximate an apex of the arch of a top face of the neck support pillow;

a sidewall height is defined by the distance between a floor of each channel in the series of channels and the top face of the neck support pillow; and the sidewall height of the apex channel is smaller than the sidewall height of at least one of the other channels in the series of channels of the neck support pillow.

* * * * *